United States Patent [19]

Potter

[11] 4,062,079

[45] Dec. 13, 1977

[54] INFLATABLE BODY SUIT

[76] Inventor: Cyril S. Potter, 82 Cleveland St., Orange, N.J. 07050

[21] Appl. No.: 603,653

[22] Filed: Aug. 11, 1975

[51] Int. Cl.[2] ..... B63C 9/12

[52] U.S. Cl. ..... 9/332; 2/2.1 R; 128/142.5

[58] Field of Search ..... 9/332, 330, 315, 316; 128/142.5, 142.7, 145, 146.5; 2/2.1 R

[56] References Cited

U.S. PATENT DOCUMENTS

| | | | |
|---|---|---|---|
| 1,154,842 | 9/1915 | Butusov | 9/319 |
| 1,204,921 | 11/1916 | Wills | 9/315 |
| 1,220,625 | 3/1917 | Grudzienski | 9/332 |
| 1,288,457 | 12/1918 | Hattori | 9/332 |
| 3,417,406 | 12/1968 | Rosenbaum | 2/2.1 R |
| 3,574,862 | 4/1971 | Jones | 2/2.1 R |

*Primary Examiner*—George E. A. Halvosa
*Assistant Examiner*—Gregory W. O'Connor
*Attorney, Agent, or Firm*—Popper & Bobis

[57] ABSTRACT

An inflatable body suit is disclosed having the shape of a union suit. The suit has a first and a second layer extending over the entire area thereof defining an air pocket between them that terminates at a seam opening large enough to allow a wearer to put on or take off the suit. A compressed air reservoir is operatively connected to the air pocket, the reservoir having at least two compartments, each compartment having a compressed air capacity sufficient to inflate the air pocket. A detachable helmet is also secured to the suit and has valves for allowing the wearer of the suit to inhale and exhale air with respect to the outside of the suit. The suit is designed to keep the wearer afloat in water.

3 Claims, 4 Drawing Figures

INFLATABLE BODY SUIT

SUMMARY OF THE INVENTION

The present invention relates to an inflatable body suit comprising a suit member in the shape of a union suit having a first layer positionable against the body of a wearer and a second outer layer positioned over said first layer, said first layer and said second layer defining an air pocket between them extending over the full area of the suit. The air pocket terminates at an opening seam of sufficient length to allow a wearer to put on and take off the suit. A compressed air reservoir is operatively connected to the air pocket through a first connector for injecting air into the pocket. The air reservoir is divided into at least two compartments, each compartment having sufficient compressed air capacity to fill the air pocket, each compartment being operatively connected to one another through a second connector member. Valve members on the compartments are provided for filling and discharging air from the compartments. An air pump is also connected to the compartments for pumping air into them. A water-tight openable and closable sealing member extends across the seam whereas a helmet is removably secured to the suit at a collar that extends upwardly therefrom. The helmet has a one-way intake valve and a one-way exhaust valve mounted therein to allow the wearer to inhale and exhale air surrounding the helmet.

DETAILED DESCRIPTION

The prior art discloses several different types of suits that are worn to keep the wearer afloat in water and are some times referred to as life saving suits. The so-called life saving suits are disclosed in U.S. Pat. Nos. 1,066,516 Moore; 1,253,370 Gieracki; 1,314,299 Zaccard et al and 1,141,116 Hovarth. Although these suits of the prior art have inflatable portions or sections, these sections do not extend over the full area of the suit and furthermore have to be inflated by blowing air into them through a tube insertable in the mouth of the wearer. These suits also do not contain any means for protecting the head of the wearer and in many instances are not watertight at the collar which causes water to fill the suit during extended periods, which not only adds to the discomfort of the wearer but also is a safety hazard in that sufficient amounts of water shipped into the suit could cause a serious loss of buoyancy.

It is therefore an object of the present invention to overcome these and other difficulties encountered in the prior art.

It is a further object of the present invention to provide an inflatable suit having an inflatable pocket that extends substantially over the full area of the suit.

It is a further object of the present invention to provide an inflatable suit that does not have to be inflated by blowing air into it by means of a tube that has to be inserted in the mouth of the wearer.

It is another object of the present invention to provide an inflatable suit having a helmet attached thereto to prevent water from getting into the suit through the neck opening.

These and other objects have been achieved according to the present invention and will become more apparent by reference to the disclosure and claims that follow as well as the appended drawing.

Figure 1:
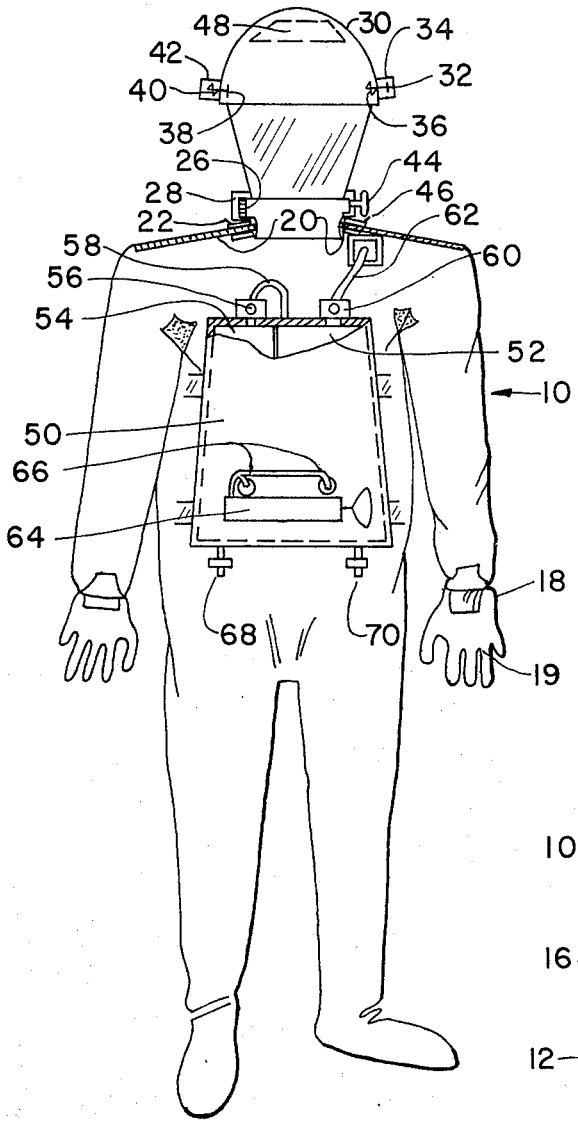
FIG. 1 illustrates a front elevation, partially in section, of an inflatable body suit according to one embodiment of the present invention.
Figure 2:
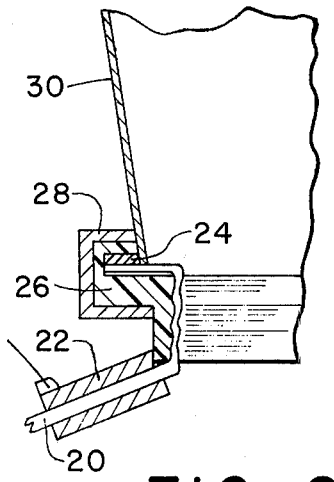
FIG. 2 illustrates a sectional view of the portion of the body suit where the helmet is joined to the collar according to another embodiment of the present invention.
Figure 3:
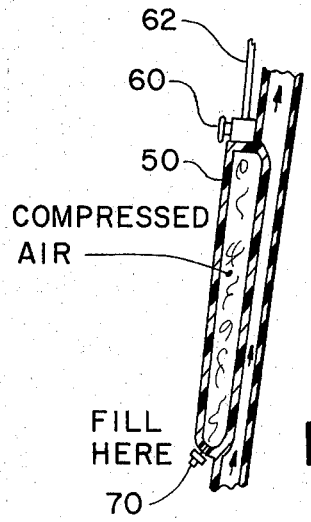
FIG. 3 illustrates a sectional view of the compressed air tank operatively connected to the body suit according to another embodiment of the present invention.
Figure 4:
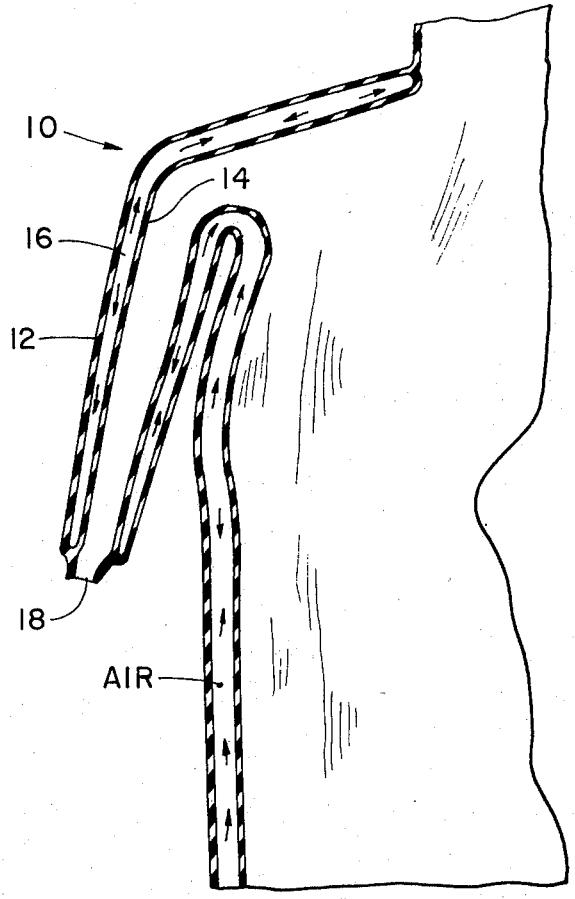
FIG. 4 illustrates a partial sectional view of a front elevation of the body suit according to another embodiment of the present invention.

Referring to the drawing and particularly FIGS. 1 through 4, an inflatable suit 10 in the shape of a union suit is illustrated having an outer wall 12 and an inner wall 14 defining an air pocket 16 that terminates in an opening at seam 20 in the shoulders of the suit, the opening being sufficiently large to allow a wearer of the suit to put on the suit and take it off through the opening. Walls 12 and 14 are preferably made of rubber. Seam 20 is openable and closable by means of zippers 22 and 46, seam 20 in this respect comprising mating zippable members that form a water tight and air tight seal when zipped shut. A neck opening in the suit extends upwardly to form split collar 26, the split in collar 26 being along the vertical side centerline of suit 10. Collar 26 extends outwardly to form a flange which is received by a sealing ring 28 that clampingly and releasably engages collar 26, handle 44 being used to open and close collar 26 which is vertically hinged to swing open on a horizontal plane away from suit 10. Handle 44 terminates in a screw shaft that passes through mating threaded openings in collar 26. Flange 24 extending from and a part of helmet 30 is inserted in collar 26 as illustrated in FIG. 2 and abuts against the upper extension of seam 20 to form a seal between suit 10 and helmet 30. Helmet 30 is made of a clear plastic material to assure that the wearer of the suit can see through the helmet. The plastic material may be any of the polymers of acrylic acid, methacrylic acid and the esters thereof or any art known equivalent thereof. Exhaust valve 32, biased by coil spring 36 is mounted in helmet 30 in valve housing 34 to allow the wearer of the suit 10 to exhale air when the suit is being worn and conversely, intake valve 38 biased by coil spring 40 and mounted in helmet 30 in valve housing 42 allows the wearer to inhale air from outside of helmet 30.

A compressed air tank 50 having chambers 52 and 54 each having a compressed air capacity equal to the volume of pocket 16 at atmospheric pressure is provided, although the tank may have a plurality of such chambers, i.e., at least two chambers. The chambers 52 and 54 are operatively connected to one another by valve 56 and tube 58, and the compressed air tank 50 is operatively connected to air pocket 16 through valve 60 and tube 62. A hand pump 64 is secured to the tank 50 and has tube 66 for providing compressed air to compartments 52 and 54. Compartments 52 and 54 may also be filled or vented by valves 68 and 70, these valves being especially useful in transferring the air from tank 50 to another suit 10, an inflatable life raft or an inflatable canoe. Although the suit as illustrated terminates in sleeve 18 and separate gloves 19 may be worn therewith, in an alternative embodiment, the gloves 19 and terminal portion of the sleeve 18 may be integral. Similarly, the integral feet of suit 10 may also be separate.

In use, suit 10 is worn as a floatation suit to support the wearer in water and is inflated by releasing compressed air from compartment 52 through valve 60 and tube 62 into air pocket 16. If additional air has to be introduced into pocket 16, valve 56 may be opened to transfer air from compartment 54 into compartment 52 which then is transferred into pocket 16. When the air supply in either compartment 52 or 54 is used up, additional air may be pumped into either compartment by pump 64 through tube 66 which is connected to both compartments 54 and 52. Air may also be pumped into these compartments through valves 68 and 70. During use valves 68 and 70 are used to inflate other suits similar to suit 10 when several people are in the water together and an emergency air reserve is needed. These valves can also be employed to fill an inflatable canoe or raft.

The suit 10 can also have various survival items stored in a pocket or pockets on the interior wall 14, these items including but not limited to seasick pills, sleeping pills, medicines, a lightweight rope to tie members of a surviving group to one another, a whistle, flashlight, radio compass, food, water, whiskey, a watch and the like.

Although the invention has been described by reference to some embodiments, it is not intended that the novel inflatable suit be limited thereby, but that some modifications thereof are intended to be included as falling within the broad scope and spirit of the foregoing disclosure, the following claims and the appended drawing.

What is claimed is:

1. An inflatable body suit comprising suit means in the shape of a union suit having a first layer positionable against the body of a wearer and a second outer layer positioned over said first layer said first layer and said second layer defining an air pocket between them extending over the full area of said suit, said air pocket terminating at opening seam means, said opening seam means being of sufficient length to allow a wearer to put on and take off said suit, water-tight openable and closable sealing means extending across said opening seam means, chest mounted compressed air reservoir means operatively connected to said air pocket through first valved connector means for injecting air into said air pocket, said air reservoir means being divided into at least two compartment means, each compartment means having sufficient compressed air capacity to fill said air pocket, each of said compartment means being operatively connected to one another through second valved connector means, valve means on each said compartment means for filling and discharging the air from each said compartment means, helmet means, air pump means operatively connected to each of said compartment means for pumping air into each of said compartment means, collar means extending upwardly from neck opening means on said suit for receiving said helmet means, sealing means for removably sealing said helmet means to said collar means, one-way inlet valve means and one-way exhaust valve means mounted in said helmet means for allowing the wearer of said suit to inhale and exhale air surrounding the suit.

2. The inflatable body suit of claim 1 where said openable and closable water-tight seal means comprises zipper means.

3. The inflatable body suit of claim 2 where said opening seam means extends from said neck means to shoulder means of said suit, said collar comprises split collar means terminating at said opening seam.

* * * * *